United States Patent [19]

Faddis et al.

[11] 4,223,603

[45] Sep. 23, 1980

[54] PLANETARY INKER FOR OFFSET PRINTING PRESS

[75] Inventors: Terry N. Faddis; Kenneth C. Clifton; Robert A. Sweet, all of Emporia, Kans.

[73] Assignee: Didde-Glaser, Inc., Emporia, Kans.

[21] Appl. No.: 2,342

[22] Filed: Jan. 10, 1979

Related U.S. Application Data

[63] Continuation of Ser. No. 802,890, Jun. 2, 1977, abandoned.

[51] Int. Cl.[3] ..... B41F 7/04; B41F 31/10

[52] U.S. Cl. ..... 101/138; 101/142; 101/180; 101/350

[58] Field of Search ..... 101/349, 350, 351, 352, 101/363, 206, 207, 208, 209, 210, 148, 137, 136, 138, 139, 142, 143, 177, 179, 180, 181, 217, 220, 221

[56] References Cited

U.S. PATENT DOCUMENTS

| | | | |
|---|---|---|---|
| 1,322,829 | 11/1919 | Schmidt | 101/350 |
| 2,065,136 | 12/1936 | Huebner | 101/350 X |
| 2,185,342 | 1/1940 | Keller | 101/350 |
| 2,986,088 | 5/1961 | Chase et al. | 101/350 |
| 3,003,416 | 10/1961 | Grobman | 101/350 |

FOREIGN PATENT DOCUMENTS

| | | | |
|---|---|---|---|
| 755843 | 11/1933 | France | 101/350 |
| 2283002 | 3/1976 | France | 101/349 |
| 116042 | 5/1918 | United Kingdom | 101/DIG. 6 |
| 305216 | 4/1930 | United Kingdom | 101/349 |

*Primary Examiner*—J. Reed Fisher

*Attorney, Agent, or Firm*—Schmidt, Johnson, Hovey & Williams

[57] ABSTRACT

A planetary inker for an offset printing press which uses only a single ink form roller but is substantially ghost free. A unique arrangement of distributor rollers operably associated with the form roller are present in sufficient number and of relative diameters with respect to each other and to the form roller to assure complete smoothing out of ink supplied to the form roller in conjunction with total elimination of all plate-derived latent images on the surface of the form roller before recontacting the plate on the plate cylinder. Especially efficient transfer of ink from the supply fountain to a drum roller in rolling contact with the form roller ahead of the distributor rollers is obtained in a preferred embodiment by the use of a pair of ink transfer ductors which are alternately intermittently shifted into engagement with the fountain ink ball and then the form roller vibrator. The relative time of engagement of the ductors with the ball and the vibrator may be selectively varied by the operator.

6 Claims, 5 Drawing Figures

PLANETARY INKER FOR OFFSET PRINTING PRESS

This is a continuation of application Ser. No. 802,890, now abandoned, filed on June 2, 1977.

This invention relates to offset lithographic printing presses and particularly to an improved planetary inker incorporating only one ink form roller for simplification of the system producing economies insofar as fabrication is concerned as well as maintenance and cleanup, without sacrifice in printing quality over multiple ink form roller trains.

In lithographic printing operations, ink from a fountain supply thereof is delivered to the ink receptive plate on the plate cylinder of the press through a series of rollers which must furnish an adequate volume of ink as used while avoiding over supply, particularly to those areas of the plate which require no ink or significantly less amounts than adjacent printing areas of the plate. In most instances, ink is removed from an ink ball rotating in the fountain through use of a ductor roller that alternates between a position contacting the ink ball to a location in rolling contact with a vibrator roller which transfers ink to a roller train. Conventionally this includes at least two oscillating vibrator rollers and a number of ink rider rollers which mill the ink transferred to them by the ductor system. Ink must be transformed from the thick surge of ink transmitted from the ink fountain into a thin uniform film of ink. The inking system must have a large enough storage capacity to prevent a visible drain on the amount of ink transmitted to the plate during the time the ink ductor is against the ink fountain. Ideally, there should be no visible difference in the amount of ink transferred to the plate at any time. Another function of the ink system is to replenish the ink to the form rollers which the plate cylinder removes from them by the time that the form rollers make one revolution and come in contact with the plate a second time. If ink is not fully replenished, poor quality printing will result. This printing will have areas which are lighter than others due to lack of sufficient ink on the form roller in those areas. This phenomenon is referred to as "ghosting". Ghosting is a serious problem on printing which requires large areas of heavy ink coverage in combination with large areas of little or no ink coverage. In order to overcome the problems of ink surge and ghosting which are diametrically opposite from each other insofar as cause and effect are concerned, it has normally been the practice to provide two, three or four form rollers in rolling contact with the plate cylinder to assure that a proper amount of ink is transferred to the plate without excessive delivery thereof.

In most inkers now in use, the roller train is oriented so that the individual rollers are positioned to receive ink from a roller higher in the train and operable to apply ink to a roller lower in the ink train. As ink is transferred from one roller to the next, the ink is smoothed out into a semi-uniform film of ink. For increased storage and better milling action, rider rollers are sometimes added to the ink train. Generally, conventional ink trains have three types of rollers. The first is soft rubber covered undriven rollers. These are generally referred to as form rollers and function to transmit ink to the plate cylinder. The second type of roller is represented by undriven metallic rider rollers which are used to transmit ink between two rubber rollers or as a rider roller on a rubber roller. Oftentimes six or more of these rider rollers are provided in a typical ink train. The third type of roller is the driven metallic roller which usually takes the form of a vibrator or distributor roll which oscillates along its axis during rotation to drive the undriven rollers, mill the ink, and distribute the ink from side to side. Generally speaking, the axial stroke of vibrator rollers is of the order of one-half to one inch.

An ink form roller in rolling contact with the plate of a printing press receives ink from the vibrator roller thereabove and applies such ink to the plate cylinder. It is assumed that when two rollers are in rolling contact the total amount of ink at the line of contact therebetween is divided equally between the two rollers. In non-printed areas of the printing plate, no ink is transmitted from the form roller to the plate. Therefore, immediately after leaving the plate, the form roller has areas which have twice as much ink as other areas where ink was picked up by the ink receptive areas of the plate. As the form roller continues to rotate, it comes in contact again with the vibrator roller. All areas of the form roller receive ink from the vibrator but the area of the form roller with the most ink originally present thereon will have a greater amount of ink after leaving the vibrator. Since the form roller is generally of substantially less diameter than the plate cylinder and thereby has less total surface area, the portions of the form roller from which ink was removed by the plate and thereby having the least amount of ink will be out of phase with the area of the plate it contacted on the previous revolution. This can result in an inconsistent amount of ink being transferred to the plate which will cause light and dark "ghosted" areas in the printing.

To overcome this problem, conventional inkers have a series of ink form rollers (two to four) around the plate cylinder. Sometimes, ink form rollers of different sizes will be used so that the ghosted areas of the form rollers will be out of phase with respect to each other. Ink will thus be deposited in the ghosted areas of the plate from the first form roller by the second form roller. Ink will next be deposited in the ghosted areas of the plate from the first and second form rollers by a third form roller, if one is present. If the machine is equipped with a forth form roller, it will deposit in the ghosted areas of the plate from the first, second and third form rollers respectively.

Although utilization of a number of ink form rollers on a plate accompanied by a large number of distributor rollers in the ink train leading from the ink fountain supply will solve most ghosting problems regardless of the copy being printed, the overall complexity of the ink train has been significantly increased and maintenance and cleanup of the equipment consumes more time and is therefore more costly to the operator, particularly where different types of jobs are sequentially run on a particular machine.

It is, therefore, a primary object of the present invention to provide an ink train for lithographic offset printing presses embodying a planetary inker using only a single, relatively large ink form roller in rolling contact with the plate of the plate cylinder, but which avoids ghosting problems without excessive supply of ink by virtue of the utilization of a unique combination of planetary oriented vibrator and rider rollers operably associated with the single ink form roller to smooth out the ink and effect even distribution thereof, notwithstanding the intermittent surge supply which is inherent in the ductor transfer of ink from the fountain ink ball to the first vibrator roller.

A further important object of the invention is to provide a planetary inker as described which overcomes many of the ink surge problems encountered with conventional systems by the utilization of a pair of ductors between the ink ball and the form roller vibrator which alternately intermittently engage the ink ball and vibrator respectively to thereby permit more continuous supply of ink to the train at a required rate without regard to press speed or layout of the copy to be printed. In this regard, a further important object of the invention is to provide a double ductor ink supply for a planetary inker wherein the relative time of engagement of each ductor with the ink ball and with the vibrator may be adjusted at will by the operator so that delivery of ink to the ink form roller may be easily and quickly adjusted as required with minimum paper wastage.

Another very important object of the invention is to provide a single ink form roller planetary inker train for offset lithographic presses wherein sufficient distributor rollers are operably associated with the form roller and of relative diameters with respect to each other and to the form roller to assure complete smoothing out of ink supplied to the form roller in conjunction with total elimination of all plate-derived latent images on the surface of the form roller during rotation thereof.

Also, an object of the invention is to provide a planetary inker as described wherein at least three planetary vibrator rollers are provided in rolling contact with the form roller around the periphery thereof and a series of rider rollers in contact with at least two of the vibrator rollers to smooth out the ink and remove all latent images from the surface of the form roller before recontact thereof with the plate on the plate cylinder. In the embodiments illustrated, the single ink form roller is of a diameter greater than that of the plate cylinder, and at least seven and preferably from eight to ten supply distributor rollers made up of vibrator rollers and rider rollers are provided around the form roller for even spreading and resupply of ink to the form roller as required. However, the form roller may be of any desired size relative to the plate cylinder provided it is of sufficient diameter to accomodate an adequate number of distributor rollers around the periphery thereof. Since in the most useful form of the invention, the rollers of the distribution train are not of the same size, the ghosted areas on the first rollers in contact with the form roller will be out of phase with the other rollers, one complete revolution of the form roller causes the ink film thereon to again be very uniform before coming into ink transferring relationship with the plate of the plate cylinder.

In the planetary inker of this invention on the other hand, one large soft rubber form roller is mounted in rolling contact with the plate of the plate cylinder. Arranged around this form roller are a series of supply and distributor rollers which include a primary vibrator roller and two sets which each include a hard metallic vibrator roller, at least two rider rollers, one of which engages the form roller while the other contacts the vibrator roller and the associated rider roller, but not the form roller and independent rider rollers between each of the cooperable sets of rollers. The purpose of the rider rollers is to provide ink storage and effect milling of the ink. The vibrator rollers serve to also mill the ink, provide additional ink storage, and distribute the ink from side to side. These functions are very similar to those which occur with the same types of roller in a conventional inking system. It was to be expected that with a single form roller in contact with the plate, ghosting would occur as it often does in ink trains heretofore in common usage. This was not found to be the case, though, since the single form roller has a sufficient number of rider rollers and vibrator rollers around it which store ink and resupply the form roller as needed. As a line on the form roller rotates past the plate cylinder, it will have light areas and dark areas as with conventional inkers. As the line passes through the rider roller and vibrator roller nips of a respective set thereof, ink will be redeposited in those areas which have less ink. This will be accomplished gradually with each roller depositing a small amount of additional ink. By virtue of the fact that the various rollers of each independent set thereof are not the same size, the ghosted areas on the first rollers will be out of phase with the other rollers of the set. After the form roller makes one complete revolution and has contacted all three sets of distributor rollers, the plate-derived latent images on the form roller are completely eliminated.

Figure 5:
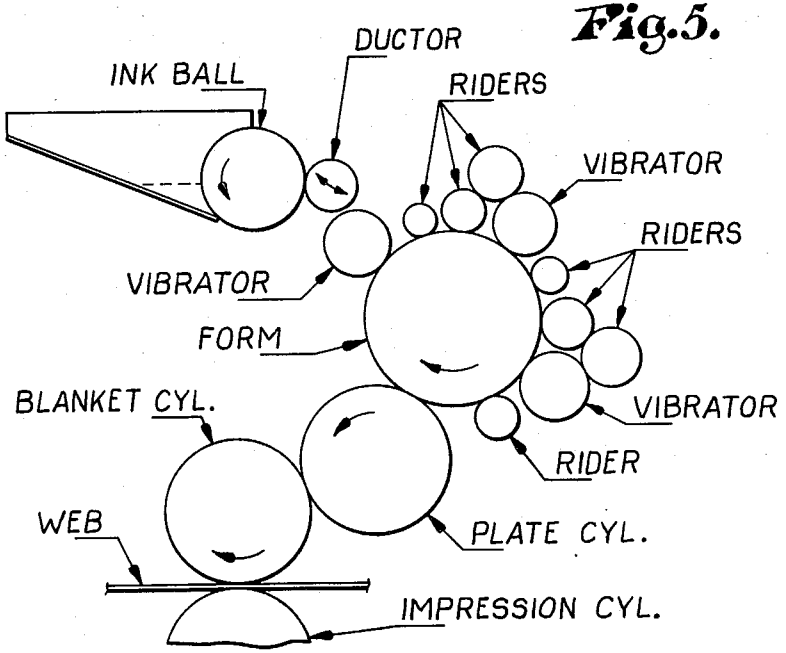
Figure 4:
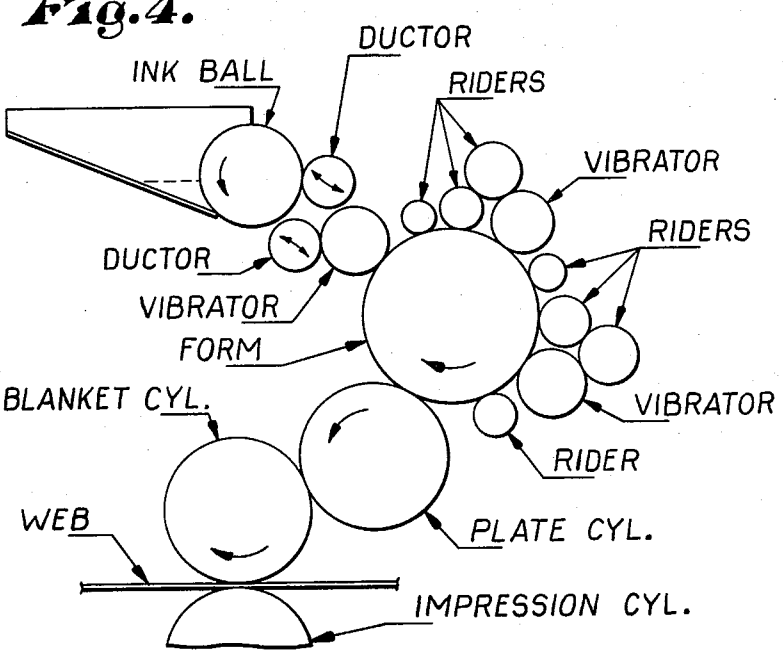

FIG. 4 is a schematic showing of a planetary inker for offset presses which are operable to print on only one side of a sheet of paper with double ductor structure being employed for transferring ink from the fountain ink ball to the vibrator roller running in contact with the ink form roller of the system; and FIG. 5 is a schematic showing of a planetary inker embodying the basic principals of the invention but in this case employing only a single ductor between the ink ball and the vibrator roller running in contact with the ink form roller.

Figure 1:
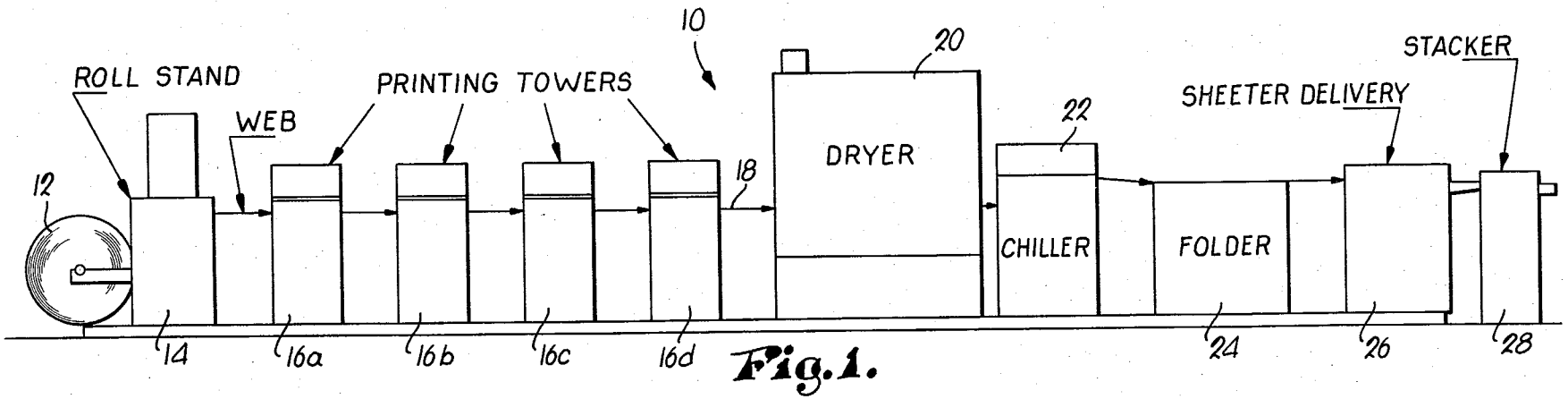
FIG. 1 is a side elevational, essentially schematic representation of a typical four color perfecting offset printing press in which planetary inker structure as described herein may advantageously be used.

In a conventional perfecting press such as indicated generally by the numeral 10 in FIG. 1, a roll 12 of paper to be printed is rotatably supported by roll stand 14 which includes web tensioning mechanism so that as the sheet material is pulled through the printing towers 16*a* and *d* inclusive, accurate match between the different colored images will be maintained for quality reproduction. The web 18 which exits from the last tower 16*d* and contains printed images on both faces thereof passes through dryer 20 and then chiller 22 before being directed to the next processing station. In many instances, this consists of a folder 24 connected to a sheeter delivery unit 26 that directs the sheets to stacker 28 which conventionally includes a jogger or the like.

Figure 2:
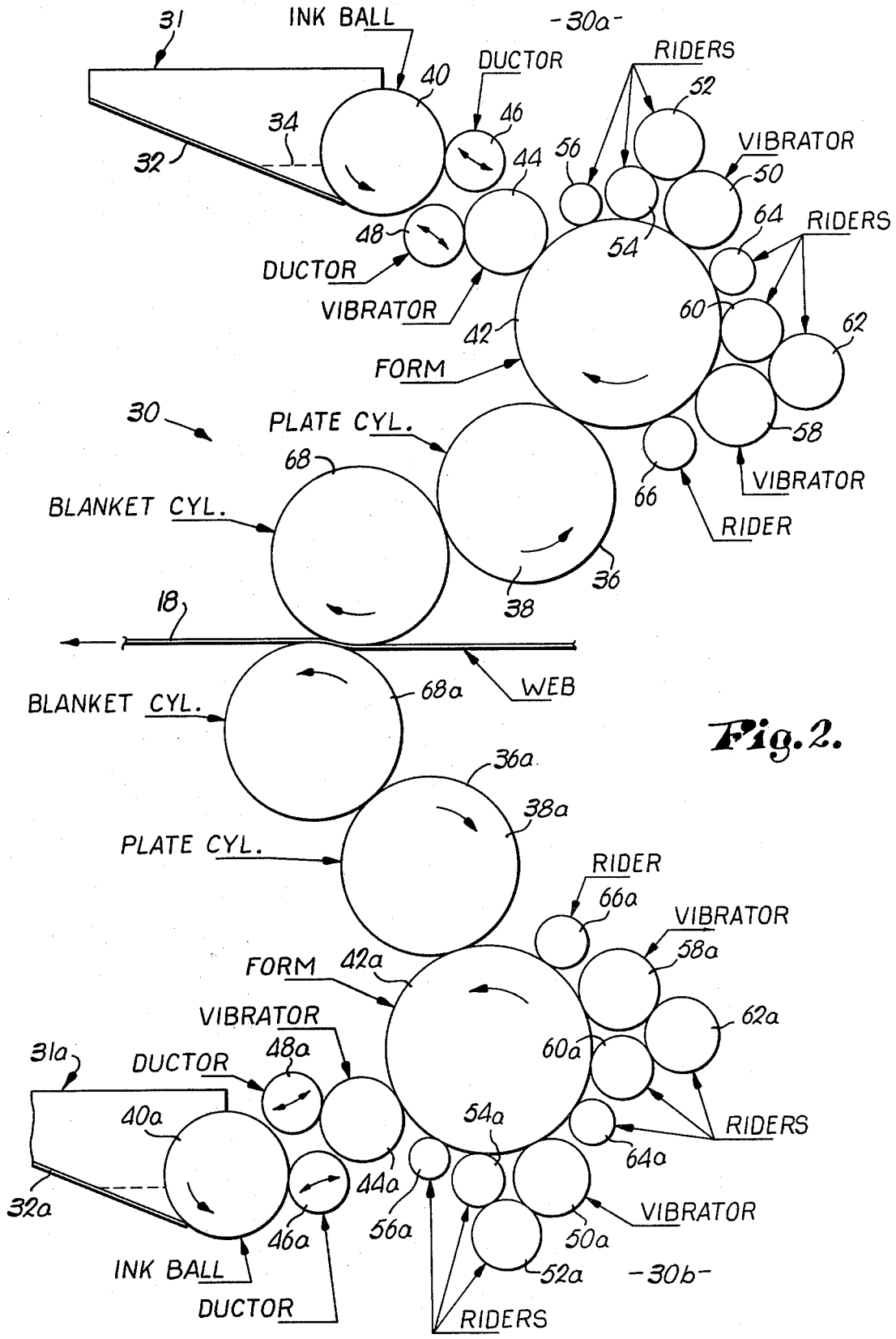
FIG. 2 is a schematic showing of the roller train of a perfecter planetary inker embodying the preferred principals of the present invention and useful in a press as shown in FIG. 1.

A planetary inker 30 of preferred construction for use in a perfecting printing tower such as towers 16*a* to 16*d* inclusive is illustrated in the FIG. 2 of the drawings, with the upper and lower ink roller trains being substantially identical except for the specific orientation of the distributor rollers with respect to the form roller.

Considering first the upper ink train of FIG. 2, an ink receiving fountain 31 has an inclined lower wall 32 which receives the viscous ink 34 to be delivered to the plate 36 on plate cylinder 38. A conventional ink ball 40 is rotatable relative to inclined wall 32 of fountain 31 in a manner to pick up ink from the supply thereof with such ink adhering to the outer surface of the ball as a uniform coating thereon determined by the stop positions of the fountain control fingers.

The upper planetary inker train 30*a* has a single relatively large, rubber-covered ink form roller 42 in rolling engagement with the plate 36 and of a diameter somewhat greater than that of plate cylinder 38 whereby the form roller has a surface area which exceeds that of the plate. A series of supply and distributor rollers made up of drum rollers and rider rollers is operably associated with form roller 42 to deliver ink thereto and smooth out the ink thereon in a manner to eliminate all plate-derived latent images before a re-inked area of the form roller moves back into ink transfering relationship with the plate. Included in the series of supply and distributor rollers is a primary roller which for example may be a drum roller such as vibrator roller 44 located between the form roller and ink ball 40. In the preferred embodiment, a pair of mutually cooperable rubber-covered ductor rollers 46 and 48 are mounted for alternate, intermittent engagement between the metal surface of ink ball 40 and metallic vibrator roller 44. Ductors 46 and 48 are alternately shiftable into engagement with ball 40 and then into rolling contact with vibrator roller 44. Preferably, means is provided for allowing the operator to selectively adjust the time during which each ductor is in engagement with the ink ball and also the time of rolling contact with vibrator 44. In addition, best results are obtained when one of the ductors is in engagement with ink ball 40 while the other ductor is in contact with vibrator 44. Ink transferred from ball 40 to vibrator 44 is delivered directly to the surface of form roller 42 as is evident from FIG. 2. Two sets of mutually cooperable distributor rollers are associated with form roller 42 along with three independently rotatable rider rollers between the remaining distributor rollers of the system and also the plate cylinder.

One of the distribution sets includes a second drum or vibrator roller 50 making up a part of the distribution system and positioned in rolling engagement with the surface of form roller 42 is spaced from vibrator 44 around the circumference of the form roller and has an outer rider roller 52 in engagement therewith, which also rolls against an inner rider roller 54 spaced from vibrator roller 50. Independent rider roller 56 rides against the surface of form roller 42 between rider roller 54 and vibrator roller 54. The vibrator roller 50 as well as the rider rollers described all are metal surfaced. It is important to note at this juncture that the rider rollers 52, 54 and 56 as well as vibrator roller 50 all have diameters which vary and thus the surface areas of the rollers are different. As will be explained, this difference in surface area is important in elimination of latent images from the surface of the form roller and also contributes to more even spreading and smoothing of the ink across the entire surface of the form roller before re-contact thereof with the plate 36.

The second set of distributor rollers includes a drum or vibrator roller 58 in rolling engagement with form roller 42 between plate 36 and vibrator roller 50. Rider roller 60 in rolling engagement with form roller 42 is spaced from vibrator roller 58 and also engages outer rider roller 62 which contacts the surface of vibrator roller 58 as well as rider roller 60. Independent rider rollers 64 and 66 engage the surface of form roller 42 in spaced relationship from the other rollers of the distributor train as is evident from the upper part of FIG. 2. It is again to be noted that the diameters of the rollers in each independent set of distributor rollers vary to provide surfaces in rolling contact with form roller 42 which are of different relative sizes. Also, if non-axially oscillatable drum rollers are used in lieu of the vibrator roller shown at respective positions of the schematic depictions of the drawings it is desirable to substitute vibrator rollers for at least certain of the rider rollers associated therewith. If for example, a non-axially oscillatable drum roller is substituted for vibrator roller 44, it is believed desirable that a vibrator roller be used in lieu of the rider roller 56. The same is true as to the other sets of distributor rollers. If a drum roller of the non-oscillating type is used in lieu of vibrator rollers 50 and 58, rollers of the vibrator type should be used instead of rider rollers 64 and 66 where a substitution has been made.

The image from plate 36 is transferred to blanket cylinder 68 which in turn deposits the ink on web 16 passing therebeneath.

In view of the fact that the planetary inker train 30*b* below web 16 is of similar construction to inker 30*a* except for relative orientation of the components, a detailed description thereof is not necessary, other than to take note of the fact that identical components have been given the same number with an "a" thereafter to distinguish the rollers and associated components from those of the upper planetary inker train.

Figure 3:
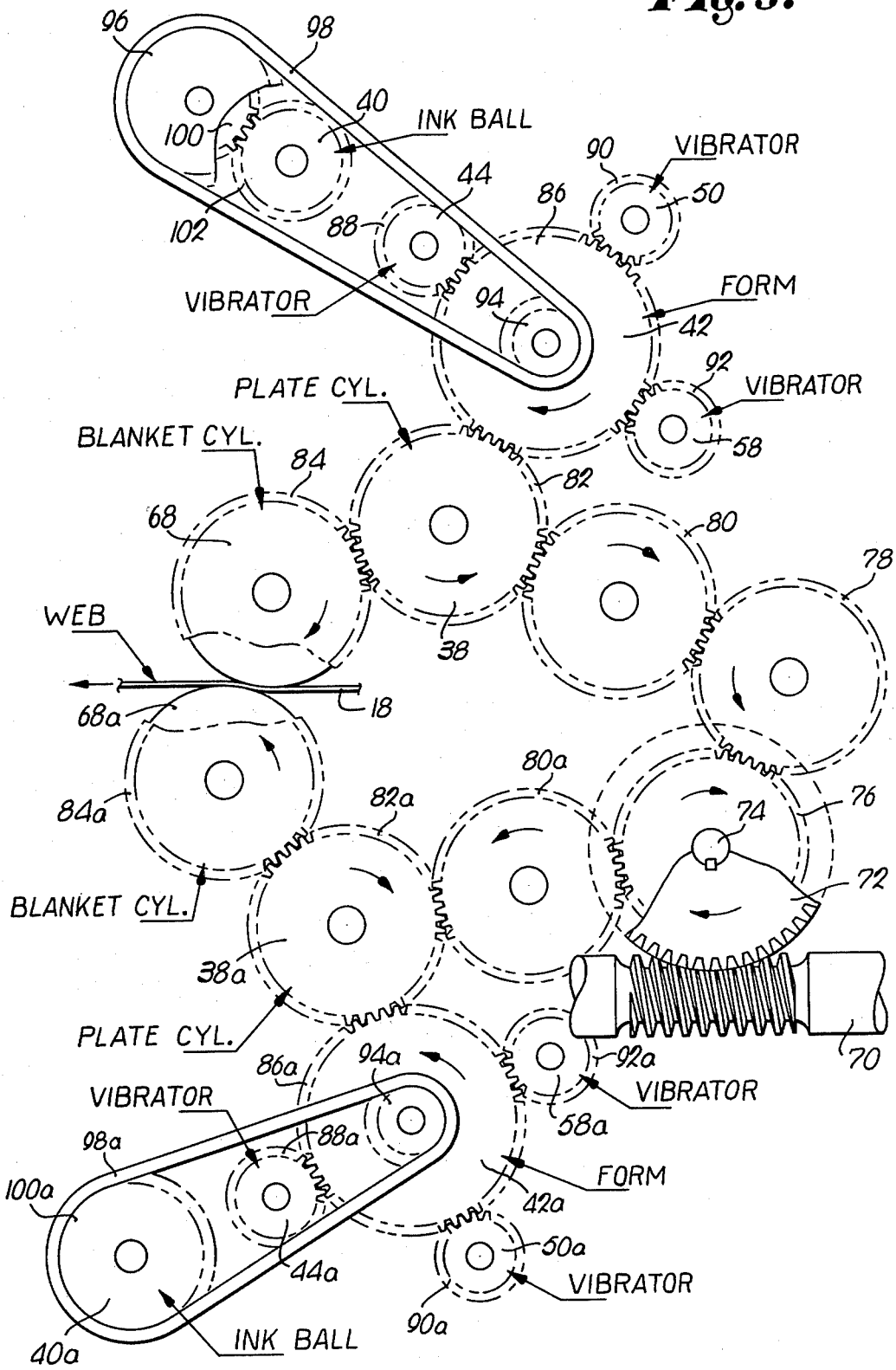
FIG. 3 is also a schematic showing of the planetary inker illustrated in FIG. 2 and depicting a preferred drive train for operating the driven rollers of the ink supply assembly.

The power train for the planetary inker 30 is shown in FIG. 3 with the rollers being in the same orientation depicted in the preceding Figure and on the same scale for a point to point comparison. Although for purposes of illustration, the main drive has been shown as comprising a worm 70, it is to be appreciated that any other type of suitable drive may be used and depends primarily on the type of power unit employed for a particular printing machine.

Worm gear 72 in operable meshing relationship to worm 70 is mounted on a shaft 74 which in turn carries a gear 76 in driving relationship to a train of spur gears which ultimately rotate blanket cylinders 68 and 68*a* at the same speed. To this end, upper blanket cylinder 68 is driven from worm gear 72 and thereby driven gear 76 through interfitting gears 78, 80 and 82 with the latter driving a gear 84 on the shaft of blanket cylinder 68. It is to be noted from FIG. 3 that gear 82 is on the shaft of plate cylinder 38 and operably drives a gear 86 on the shaft of form roller 42. In a similar manner, blanket cylinder 68*a* is driven through gears 80*a* in mesh with gear 76 as well as gear 82*a* which meshes with a gear 84*a* on lower blanket cylinder 68*a*. Again the gear 82*a* is used to drive form roller 42*a* through gear 86*a* which meshes with gear 82*a*.

Planetary gears 88, 90 and 92 mesh with gear 86 of form roller 42 and serve to drive respective vibrators 44, 50 and 58 while the lower planetary gears 88*a*, 90*a* and 92*a* serve to rotate corresponding vibrators 44*a*, 50*a* and 58*a*.

Sprocket 94 on the shaft of form roller 42 is operably connected to sprocket 96 adjacent ink fountain 31 by roller chain 98. Gear 100 on the shaft for gear 96 meshes with gear 102 of ink ball 40. In the case of the lower planetary inker, sprocket 94*a* of form roller 42*a* is in driving engagement with sprocket 100*a* of ink ball 40*a* through the medium of roller chain 98*a*.

The operation of planetary inker 30 is believed to be generally evident from the preceding description, but in amplification thereof, it is to be appreciated that plate cylinders 38 and 38*a* as well as blanket cylinders 68 and 68*a* are positively driven at the same surface speed by main worm 70 and that at the same time, form rollers 42 and 42*a* are driven at the surface speed of the plates 36 and 36*a* while planetary vibrator rollers 44, 50 and 58 as well as similar vibrator 44*a*, 50*a*, and 58*a* rotate at the same surface speed as the form rollers engaged thereby. Ink balls 40 and 40*a* are positively driven from the main drive through roller chains 98 and 98*a* thus assuring accurate timing of all of the primary rollers of the ink distribution system. Ductors 46 and 48 as well as 46*a* and 48*a* are oscillated back and forth between positions engaging ink ball 40 and corresponding vibrators 44 and 44*a*. As will be understood by those skilled in this art, the ductors do not remain in contact with a corresponding ink ball for any significant period of time but do contact a respective vibrator for a significantly longer time interval. For example, each ductor will remain in engagement with a respective ink ball only long enough to place a line of ink along the ductor of a width of the order of $\frac{1}{4}$ to $\frac{1}{2}$ in. However, the ductors will remain in engagement with the primary vibrator roller associated therewith for at least one revolution of the ductor and usually somewhat greater than that. Also, as previously mentioned, the time cycles of the ductors in engagement with the ink ball and vibrator respectively may be altered by the operator of the press at will depending upon the ink demands for a particular job.

In all instances, two problems which are presented to printers that require resolution for each job are done more efficiently with planetary inker 30 than possible with prior systems and at lower cost to the operator.

The inker should not be pattern-dependent, but capable of providing substantially 100% coverage of ink at any density needed for an area to be printed. As can be appreciated, the problem is often complicated by the fact that one part of the sheet laterally thereof may require delivery of considerably more ink to the printing plate than the opposite side. This inherently involves the second problem wherein the pattern-independent inking system must be functional without ghosting or the printing will become gradually lighter in density as the work progresses.

It is for this reason that the single form rollers used in each of the ink trains of FIG. 2 are not exactly the same size as respective plate cylinder. The form roller may be the same size, larger or smaller than the plate cylinder, with advantageous results being obtained in all instances. In view of the fact that sufficient distributor rollers are provided around the circumference of the form roller, there is no problem of ghosting under any print conditions.

Directing primary attention to the upper planetary inker of perfecting inking system 30, it can be seen that oscillation of the ductors 46 and 48 between between ink ball 40 and vibrator roller 44 causes lines of ink to be transmitted to the surface of the vibrator for ultimate transfer to the surface of form roller 42. However, since ductors 46 and 48 remain in engagement with vibrator 44 for at least one rotation of each of the ductors, the one-quarter or one-half inch line of ink laid down on a respective ductor is deposited on the surface of vibrator 48 throughout a substantially wider area, dependant upon the time of engagement of a corresponding ductor with the vibrator during rotation of the latter. The ink on vibrator 48 is divided in half as it contacts the form roller 42 which rotates in the direction of the arrow illustrated in FIG. 2. Rider roller 56 picks up a quantity of the ink smoothing the latter out and acting as a partial supply source for ink during overall operation of the machine. The ink again divides between that present on the rider roller 56 and the surface of form roller 42 whereupon the ink delivered as a replenishment for that removed, next comes into engagement with rider roller 54 where division again occurs with part of the ink being retained on rider roller 54 while the other half moves into engagement with vibrator roller 50. Axial oscillation of vibrator roller 50 serves to spread the ink end to end of form roller 42 while at the same time further milling and smoothing the ink. Rider roller 52 in association with vibrator roller 50 and rider roller 54 acts as a reservoir for ink while continuing to smooth out the supply which tends to come in surges by virtue of the ductor operation of rollers 46 and 48 between ink ball 40 and vibrator roller 44.

Division of the ink again occurs when picked up by rider roller 64 and the set of distributor rollers presented by rider roller 60, rider roller 62 and vibrator roller 58 which operate in the manner similar to that described with respect to rider rollers 52 and 54 as well as vibrator roller 50. Final smoothing and division of the ink occurs with rider roller 66 which is operable against the surface of form roller 42 independently of the remainder of the distributor rollers.

As previously mentioned, the relative sizes of the distributor rollers in the respective sets thereof is important to functioning of the planetary inker in an unexpected fashion in that there is no direct overlapping repeat of plate-derived latent images at any time on any of the rollers since they are all essentially out of phase because of the differences in relative surface areas thereof. Computer simulation studies have shown that even though a single form roller is used in association with the plate cylinder, the overall capacity of the planetary inker system is greater than with conventional inking systems heretofore employed, embodying a substantially larger number of rollers, and with complete elimination of ghosting because of successive transfer of latent images from one roller to another because of inadequate supply of ink to the plate upon re-contact to the surface of the form with a particular printing area thereof.

In addition, the planetary inker of this invention has distinct advantages over prior systems in that it is substantially more compact, involves fewer rollers, all of which work with maximum efficiency, and there is less maintenance, and repair required and clean-up of the press is faster. Furthermore, the planetary inker especially lends itself to use in a perfecting press as depicted in FIG. 1 since vertical height is at a premium in a printing tower which prints on both sides of the paper, thus making it necessary to locate the inker train in a minimum space, particularly from the standpoint of vertical orientation.

However, the planetary inker has application in one side printing and examples of useful embodiments of this invention are illustrated in FIGS. 4 and 5. FIG. 4 shows a single side printing inker which is identical to that shown in FIG. 2, except that an impression cylinder replaces the blanket cylinder of the lower printing assembly. In all other respects, as indicated by the schematic representation of FIG. 4, the inker train is identical in construction and operation to that described in detail above. It is to be appreciated in this respect, though, that the particular sizes of the rollers is not critical to successful operation of the unit and this may be varied as necessary for space requirements or inking demands of each machine on which the system is used. Thus, it can be seen in FIG. 4 that a double ductor design is used to transfer ink from the ink ball to the primary vibrator roller in engagement with the form roller. In FIG. 5 on the other hand, a one sheet printing assembly is illustrated wherein an impression cylinder is positioned below the blanket cylinder but in this case with only one ductor being provided for oscillation between the ink ball and the primary vibrator roller. Although the double ductor configuration is preferred from the standpoint of a more continuous supply of ink to the form roller, in many instances a single ductor is satisfactory, particularly where the jobs to be printed do not normally demand high levels of ink or substantial areas of high density. Exemplary in this respect would be forms presses wherein only limited material is printed on the sheet in the forms of headings, margin notations and the like.

Having thus described the invention, what is claimed as new and desired to be secured by Letters Patent is:

1. In an offset printing press having a blanket cylinder, a plate cylinder rotating in contact with the blanket cylinder, and ink fountain means, the combination therewith of a planetary inker for supplying ink to a plate on the plate cylinder from the ink fountain means without significant ghosting and comprising:

a single rubber coated ink form roller positioned to rotate in rolling contact with the plate on said plate cylinder, said ink form roller being of greater diameter than said plate cylinder, a first gear coupled to said ink form roller at one end thereof in axial relationship thereto for effecting rotation of the ink form roller, said first gear having an effective diameter approximately equal to that of the ink form roller;

a second gear secured to said plate cylinder axially thereof, of approximately equal diameter to that of the plate cylinder and in operable intermeshing relationship to the first gear to effect rotation of the ink form roller at the same surface speed as that of the plate cylinder;

a series of metal distributor rollers of varisized diameters around and in rolling contact with the form roller, one of the distributor rollers being operably associated with the ink fountain means for receiving ink therefrom and supplying such ink to the form roller at a controlled rate, there being at least six distributor rollers of which at least two form a pair that are longitudinally oscillatable vibrator rollers in circumferentially spaced relationship about the periphery of the form roller and at least one non-oscillatable distributor roller between each adjacent pair of oscillatable vibrator rolls;

a planetary gear secured to an end of each of the vibrator rolls, of approximately the same diameter as a respective vibrator roller and located to intermesh with said first gear on the ink form roller to cause all of the vibrator rollers to rotate at the same surface speed as the ink form roller and said plate cylinder; and gear drive means for positively driving at least one of said first and second gears.

2. In an offset press as set forth in claim 1 wherein said distributor rollers include at least a pair of non-oscillatable first rider rollers in rolling contact with the form roller, each of said first rider rollers being disposed in spaced relationship from a respective one of said two vibrator rollers, there being at least two more non-oscillatable second rider rollers each of which is between and in rolling engagement with one of said first rider rollers and an adjacent one of said vibrator rollers and out of rolling contact with the form roller.

3. In an offset press as set forth in claim 2 wherein each vibrator roller, each first rider roller, and each second rider roller have different diameters relative to one another and smaller diameters than said form roller.

4. In an offset press as set forth in claim 2 wherein said distributor rollers include another rider roller in rolling engagement with said form roller in spaced relationship from the remainder of the distributor rollers.

5. In an offset press as set forth in claim 2 wherein said distributor rollers include a plurality of additional rider rollers in rolling engagement with said form roller in spaced relationship from one another and the remainder of the distributor rollers.

6. In an offset press as set forth in claim 1 wherein said pair of vibrator rollers are located against the ink form roller between the distributor roller receiving ink from the fountain means and the contact line between the ink form roller and the plate cylinder.

* * * * *